US009908752B2

(12) United States Patent
Huang

(10) Patent No.: US 9,908,752 B2
(45) **Date of Patent: *Mar. 6, 2018**

(54) TORQUE LIMITING AND CONICAL BRAKING ASSEMBLY FOR POWER WINCH

(71) Applicant: Comeup Industries Inc., Taipei (TW)

(72) Inventor: Shih Jyi Huang, Taipei (TW)

(73) Assignee: Comeup Industries Inc., Taipei (TW)

( * ) Notice: Subject to any disclaimer, the term of this patent is extended or adjusted under 35 U.S.C. 154(b) by 271 days.

This patent is subject to a terminal disclaimer.

(21) Appl. No.: 14/936,771

(22) Filed: Nov. 10, 2015

(65) Prior Publication Data

US 2016/0311668 A1 Oct. 27, 2016

(30) Foreign Application Priority Data

Apr. 24, 2015 (TW) ..... 104206235 U
Apr. 27, 2015 (CN) ..... 2015 2 0260307

(51) Int. Cl.

| | |
|---|---|
| ***B66D 1/14*** | (2006.01) |
| ***B66D 1/12*** | (2006.01) |
| ***B66D 1/16*** | (2006.01) |
| ***B66D 1/00*** | (2006.01) |
| ***B66D 1/22*** | (2006.01) |
| ***B66D 1/58*** | (2006.01) |

(52) U.S. Cl.

CPC ..... *B66D 1/14* (2013.01); *B66D 1/00* (2013.01); *B66D 1/12* (2013.01); *B66D 1/16* (2013.01); *B66D 1/22* (2013.01); *B66D 1/58* (2013.01)

(58) Field of Classification Search

CPC ... B66D 1/00; B66D 1/12; B66D 1/14; B66D 1/16; B66D 1/22; B66D 1/58

USPC ..... 254/274, 344

See application file for complete search history.

(56) References Cited

U.S. PATENT DOCUMENTS

| | | | | | |
|---|---|---|---|---|---|
| 3,985,047 | A | * | 10/1976 | Therkelsen | B66D 1/14 254/354 |
| 3,986,588 | A | * | 10/1976 | Kuzarov | B66D 1/16 188/218 XL |
| 4,004,780 | A | * | 1/1977 | Kuzarov | B66D 1/16 254/345 |
| 4,461,460 | A | * | 7/1984 | Telford | B66D 1/22 188/337 |
| 4,545,567 | A | * | 10/1985 | Telford | B66D 1/22 188/337 |
| 4,736,929 | A | * | 4/1988 | McMorris | B66D 1/22 254/323 |

(Continued)

*Primary Examiner* — Michael E Gallion

(74) *Attorney, Agent, or Firm* — Alan D. Kamrath; Kamrath IP Lawfrim, P.A.

(57) ABSTRACT

Disclosed is a torque limiting and conical braking assembly for a power winch. In the process of outputting power by a power supply and transmitting the power to a reduction mechanism, a torque limit mechanism formed by a torque shaft, a friction pad, a brake pad, a disc-shaped elastic element, an adjustable positioning ring and a positioning screw ring and a conical braking mechanism formed by a brake block, a disc-shaped rim, a wedge block and a bump are installed, so that when the reverse torque produced by the carrying load of the power winch exceeds the torque bearable by the power supply, the power transmission is cut off immediately and a conical braking effect is produced to protect the transmission mechanism from being damaged.

1 Claim, 5 Drawing Sheets

(56) References Cited

U.S. PATENT DOCUMENTS 5,261,646 A * 11/1993 Telford ..... B66D 5/08 188/343
5,638,935 A * 6/1997 Fehring ..... F16D 43/10 192/105 B
6,604,731 B2 * 8/2003 Hodge ..... B66D 1/22 254/344
7,000,904 B2 * 2/2006 Huang ..... B66D 1/22 254/323
7,222,700 B2 * 5/2007 Elliott ..... F16D 67/00 188/166
7,270,312 B1 * 9/2007 Phipps ..... B66D 1/22 254/278
7,374,153 B2 * 5/2008 Huang ..... B66D 5/02 254/267
7,568,559 B2 * 8/2009 Huang ..... B66D 5/06 188/72.7
7,703,751 B2 * 4/2010 Elliott ..... B66D 1/22 254/344
7,891,641 B1 * 2/2011 Miller ..... B66D 1/16 254/344
7,922,153 B2 * 4/2011 Zhou ..... B66D 1/22 254/323
8,434,742 B2 * 5/2013 Akhavein ..... B66D 3/006 254/344
8,973,902 B2 * 3/2015 Huang ..... F16D 11/16 254/355
9,266,702 B2 * 2/2016 Fretz ..... B66D 1/02
9,487,381 B2 * 11/2016 Huang ..... B66F 3/44
2003/0001148 A1 * 1/2003 Huang ..... B66D 5/22 254/378
2008/0000735 A1 * 1/2008 Huang ..... B60T 13/02 188/171
2014/0174879 A1 * 6/2014 Huang ..... F16D 11/16 192/71
2016/0068376 A1 * 3/2016 Fretz ..... B66D 3/00 254/219
2016/0311667 A1 * 10/2016 Huang ..... B66D 1/12

* cited by examiner

TORQUE LIMITING AND CONICAL BRAKING ASSEMBLY FOR POWER WINCH

BACKGROUND OF THE INVENTION

Field of the Invention

The present invention relates to a torque limiting and conical braking assembly for a power winch, and more particularly to the torque limiting and ratcheted brake assembly capable of timely cutting off the power whenever the reverse torque produced by a carrying load exceeds the bearable torque of the power supply while producing a conical braking effect, so as to prevent the power winch from being damaged by a transmission mechanism.

Description of the Related Art

Power winch is a device designed for hanging or dragging a load. For example, a hoist is a common application of the power winch, and a cable winch installed at the front of a jeep or a cross-country vehicle for trailing another car (to help others) or moving out of danger (to rescue oneself) is another common application of the power winch. The principle of operating the power winch is to output a forward or reverse transmission power by a power supply (such as a power motor) and acted by a reduction mechanism to drive a cable wheel to rotate in a forward or reverse direction to release or retrieve a cable, and a load (such as a heavy object, another car, or another object) is hooked by a heavy-duty hook installed at a front end of the cable, so as to move the load conveniently.

Since the winch carries a load (such as goods, objects, or people waiting to be rescued), and the load sometimes exceeds the torque bearable by the power supply (which involves the loading capacity of the power supply), therefore a torque limit mechanism with an overload protection is generally installed in a transmission mechanism for preventing any torque produced by the load and unbearable by the power supply, such that if an overload occurs, the torque limit mechanism will rotate idly and slip and will no longer transmit power, so as to protect the transmission mechanism (such as a power motor, a reduction mechanism, etc) of the power winch, and prevent the components of the power winch from being damaged by the overload. In the meantime, an unpowered braking mechanism is further installed in the transmission mechanism for stopping a power transmission process immediately whenever the power winch is unpowered (by pressing a stop button or by a power failure), so as to protect the transmission mechanism from being damaged.

However, the torque limit mechanism and the unpowered braking mechanism of a conventional power winch are designed as two separate devices. For example, a conventional current breaker is used as the torque limit mechanism such that when the torque of the load increases, the current of the power supply current also increases. Therefore, the power of the power supply will be disconnected when there is an overload of current, so as to provide the effect of limiting the torque indirectly; and a conventional electromagnetic brake clutch is used as the unpowered braking mechanism, and both current breaker and electromagnetic brake mechanism are installed at different positions of the transmission process of the power winch, and thus doubling the cost, causing unsmooth operation (when the compatibility of the two mechanisms is low), and/or even damaging the components over a long time of use.

Besides the use of the current breaker as the torque limit mechanism and the use of the electromagnetic brake clutch as the unpowered brake mechanism by the power winch, the winch power cannot be used at all during power failure. In addition, it takes a buffer time for the current breaker and the electromagnetic brake clutch to be turned on and off, and an immediate effect cannot be achieved. Therefore, the power transmission of the power winch cannot be disconnected and the power winch cannot be stopped immediately when an overload occurs. Obviously, the practicality of the conventional power winch requires improvements.

SUMMARY OF THE INVENTION

Therefore, it is a primary objective of the present invention to install a compatible component capable of producing a torque limiting effect and a compatible component capable of producing a conical braking effect into a transmission mechanism of a power winch to provide both torque limiting and ratcheted braking effects.

To achieve the aforementioned and other objectives, the present invention provides a torque limiting and conical braking assembly for a power winch, comprising: a frame, a power supply installed on a side of the frame and capable of outputting power; a reduction gearbox installed on the other side of the frame and including a reduction mechanism installed therein, and a long shaft being driven to rotate by the power of the power supply to provide a reduction effect, a cable wheel installed at the middle of the frame and driven to rotate by the power outputted by the reduction gearbox; a sectional shaft being installed between the long shaft and the reduction mechanism for transmitting power indirectly and sheathed on the long shaft in a non-contact manner, and ring walls at both ends of the sectional shaft having an engaging gear and a ring-shaped engaging slot, and the sectional shaft having a positioning hole formed thereon, and an end of the sectional shaft being engaged and linked with the reduction mechanism by the engaging gear at the respective end and a C-shaped retainer ring being inserted into the engaging slot at the respective end, and an elastic element being covered onto the sectional shaft, and an end of the elastic element being inserted into the positioning hole of the sectional shaft, characterized in that in the process of transmitting power from the long shaft to the reduction mechanism, a conical braking mechanism and a torque limit mechanism are installed, wherein the conical braking mechanism is comprised of a brake block, a disc-shaped rim, a wedge block and a bump; the brake block has an outwardly and obliquely expanded conical friction surface formed at the outer periphery of the brake block, and a large through hole formed at the center of the brake block; the disc-shaped rim is comprised of a disc-shaped portion and a rim portion, and the disc-shaped portion and the brake block are combined into a jointly rotating body, and the rim portion is entered into a large through hole of the brake block and sheathed on the sectional shaft in a non-contact manner, and a gap exists between the rim portion and the large through hole of the brake block, and the rim portion has a plurality of up-and-down bevels formed on an end surface of the outer wall of the rim portion and a pair of outwardly protruding convex latching bodies formed at opposite ends of the outer wall of the rim portion, and the other end of the elastic element is abutted at the rear end surface of the rim portion to push the jointly rotating body to move outward; the wedge block has an engaging gear installed to an inner wall at the inner periphery of a center hole of the wedge block and engaged and linked with the engaging gear on a ring wall of the other end of the sectional shaft, and a C-shaped retainer ring is inserted into the engaging slot at the respective end, and the wedge block has a bevel and a convex latching body corresponsive to the bevel and the convex latching body of the disc-shaped rim respectively, and the convex latching body of the wedge block and the convex latching body of the disc-shaped rim are installed with slightly different angles respectively; the bump is formed inside an inner housing which is covered onto the long shaft and an end facing the wedge block is an opening and an end away from the wedge block has a through hole, and the ring wall at the opening end of the inner housing is inserted between the large through hole of the brake block, the convex latching body of the disc-shaped rim and the convex latching body of the wedge block, and the bump is formed on a ring wall inside the opening end of the inner housing and configured to be corresponsive to the convex latching body of the disc-shaped rim and the convex latching body of the wedge block.

The torque limit mechanism is formed by a torque shaft, a friction pad, a brake pad, a disc-shaped elastic element, an adjustable positioning ring and a positioning screw ring, and the torque shaft has an axial through slot formed therein, a latching slot formed at a front end of the torque shaft, a threaded section formed at the outer periphery of the torque shaft, an axially penetrated positioning cavity, and a ring wall formed at a rear end of the torque shaft; the friction pad is a ring shaped plate having a surface with a friction effect; the brake pad is a ring shaped plate made of a lining material and has a positioning protrusion formed at the inner periphery of the brake pad; the disc-shaped elastic element is substantially in a concave arc shape and has a compressive elasticity; the outer periphery of the adjustable positioning ring has a plurality of positioning plates selectively bent towards the positioning screw ring; the positioning screw ring has a shaft hole with a reverse inner thread, and a plurality of positioning slots symmetrically formed at the outer periphery of the positioning screw ring and for selectively bending, pressing, and remaining the positioning plate therein; during assembling, the torque shaft is passed through the friction pad and the through hole of the inner housing to attach the friction pad to the ring wall of the torque shaft, and the through slot of the torque shaft is sheathed on the long shaft, so that an end of the long shaft may be inserted into the latching slot of the torque shaft for a close connection, and then the brake pad is covered onto the torque shaft outside the inner housing, and the positioning protrusion of the brake pad is entered into the positioning cavity of the torque shaft, and the disc-shaped elastic element, the adjustable positioning ring and the positioning screw ring are sheathed on the torque shaft sequentially, and the shaft hole of the positioning screw ring is screwed and engaged with the threaded section of the torque shaft until the torque shaft, the friction pad, the inner housing, the brake pad, the disc-shaped elastic element, the adjustable positioning ring and the positioning screw ring are packed, and then the positioning plate of the adjustable positioning ring is bent and pressed into the corresponsive positioning slot of the positioning screw ring.

DETAILED DESCRIPTION OF THE PREFERRED EMBODIMENTS

The technical characteristics, contents, advantages and effects of the present invention will be apparent with the detailed description of a preferred embodiment accompanied with related drawings as follows.

Figure 1:
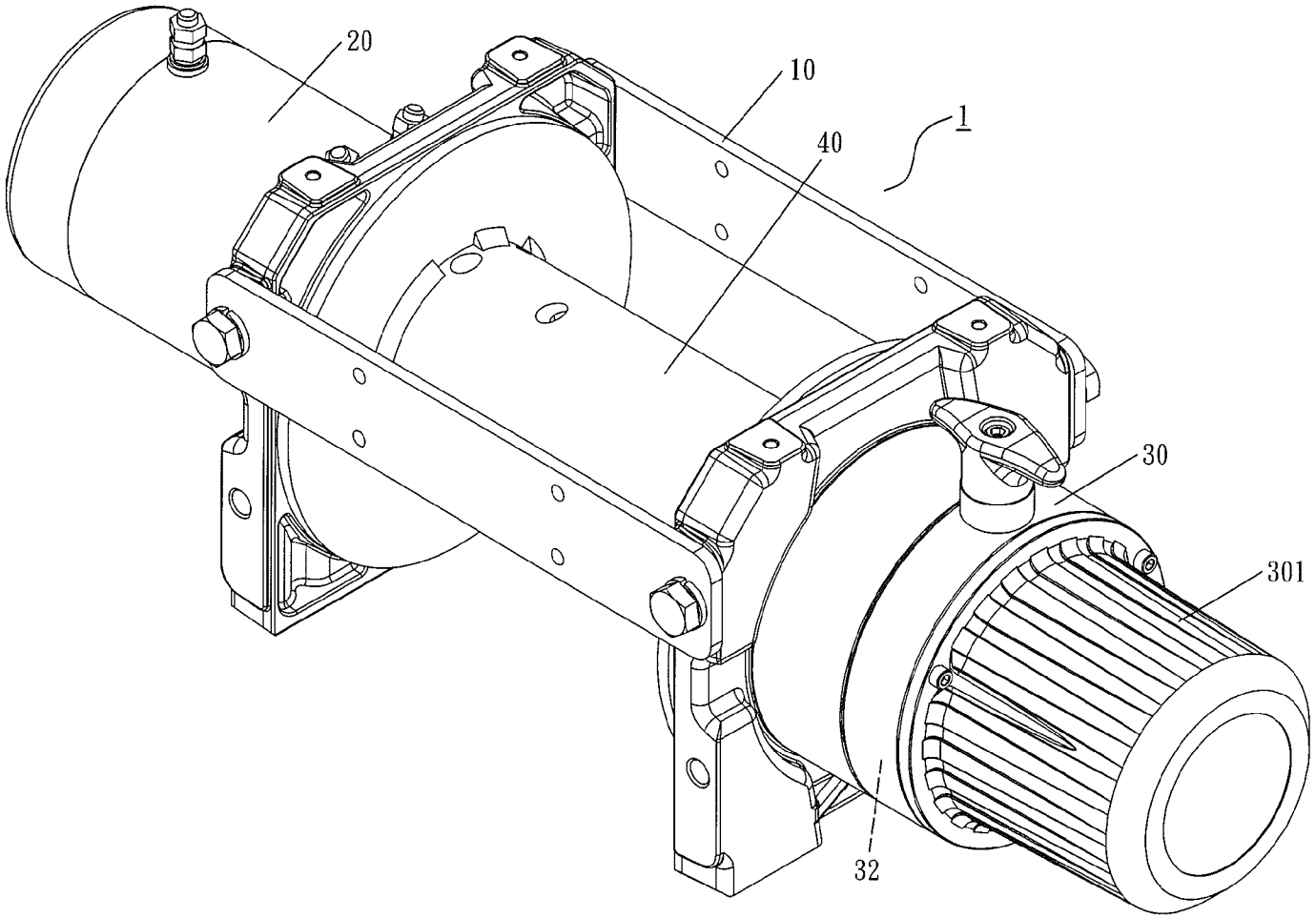
FIG. 1 is a perspective view of a preferred embodiment of the present invention.
Figure 5:
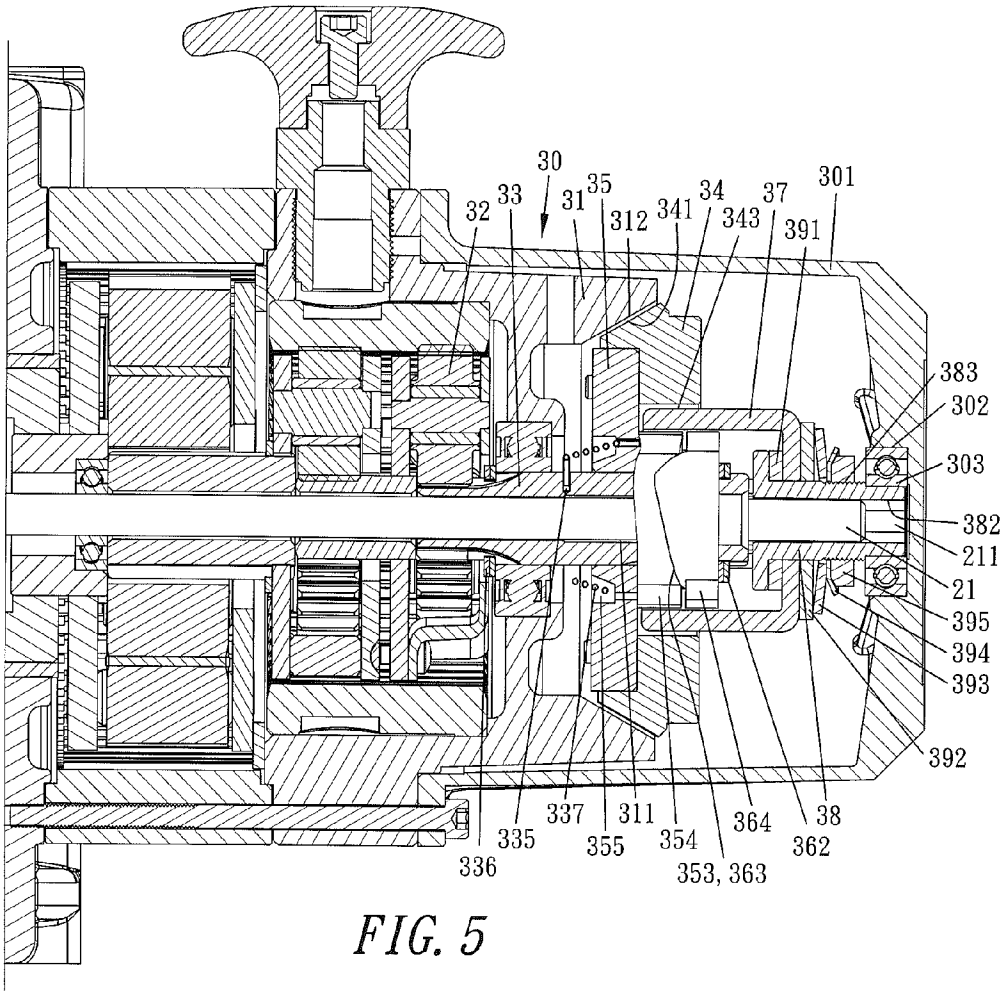
FIG. 5 is a cross-sectional view of a preferred embodiment of the present invention.

With reference to FIG. 1 for a power winch 1 in accordance with a preferred embodiment of the present invention comprises: a frame 10; a power supply 20, such as a power motor installed on a side of the frame 10, and capable of outputting a forward power or a reverse power; a reduction gearbox 30 installed on the other side of the frame 10, and including a reduction mechanism 32 (as shown in FIG. 5) installed therein, for receiving the power transmission from the power supply 20 for reduction; and a cable wheel 40 installed at the middle of the frame 10 and driven to rotate by the power outputted from the reduction gearbox 30, so as to release a cable (not shown in the figure) or retrieve the cable.

In FIGS. 2 to 5, after a rear cover 301 of the reduction gearbox 30 is removed, a long shaft 21 is directly and synchronously driven by a center shaft of the power supply 20 and extended out from a central through hole 311 of an inner circular shell 31, and an end of the long shaft 21 is formed as a non-circular latching end 211 such as a latching end in a hexagonal shape. An accommodating groove 302 is formed at the center of the innermost-depth end surface of the rear cover 301 (as shown in FIG. 5) and provided for containing and positioning a closely installed bearing 303 therein. A reduction mechanism 32 is installed in the interior of the inner circular shell 31 (as shown in FIG. 5) and driven and reduced by a plurality of layers of planetary gear sets which jointly form the reduction mechanism 32, and the inner periphery of the outer side of the inner circular shell 31 is an outwardly expanded oblique friction surface 312. A sectional shaft 33 sheathed on the long shaft 21 without being in contact (in other words, the long shaft 21 is passed through the longitudinal shaft hole of the sectional shaft 33 with a gap from the longitudinal shaft hole). An engaging gear 331, 332 and a ring-shaped engaging slot 333, 334 are formed on ring walls at both ends respectively, and a positioning hole 335 is formed on a sectional shaft, and an end of the sectional shaft 33 with the engaging gear 331 and the engaging slot 333 is extended into the central through hole 311 of the inner circular shell 31, and the engaging gear 331 and the reduction gearset 32 at the end are engaged and linked. A C-shaped retainer ring 336 is inserted into the engaging slot 333 (as shown in FIG. 5) and provided for limiting and preventing the sectional shaft 33 from being withdrawn freely.

An elastic element 337, preferably a volute spring, is sheathed on the sectional shaft 33, and an end of the elastic element 337 is inserted and positioned into the positioning hole 335.

Figure 3:
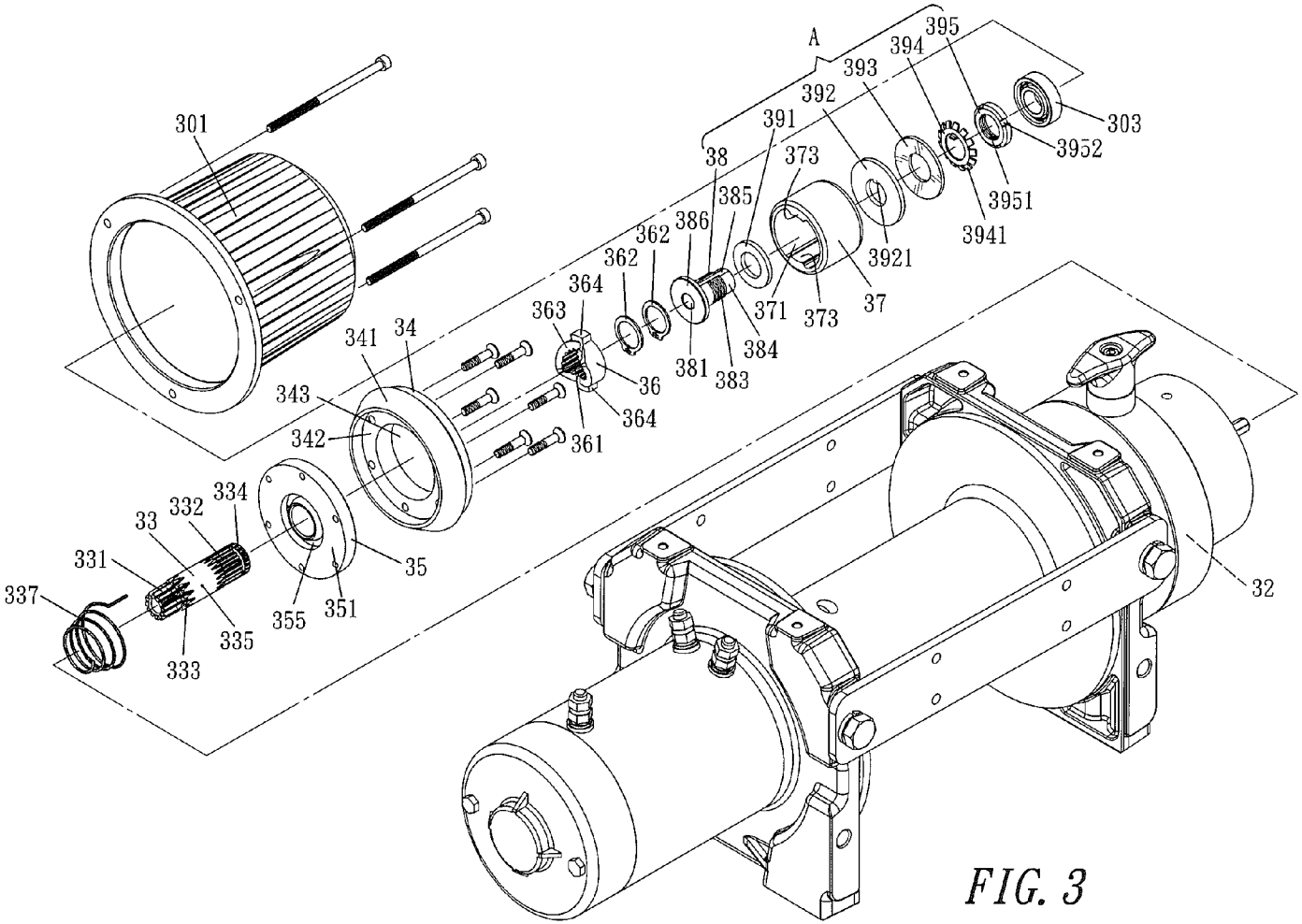
FIG. 3 is a perspective view of a preferred embodiment of the present invention viewing from another angle.
Figure 4:
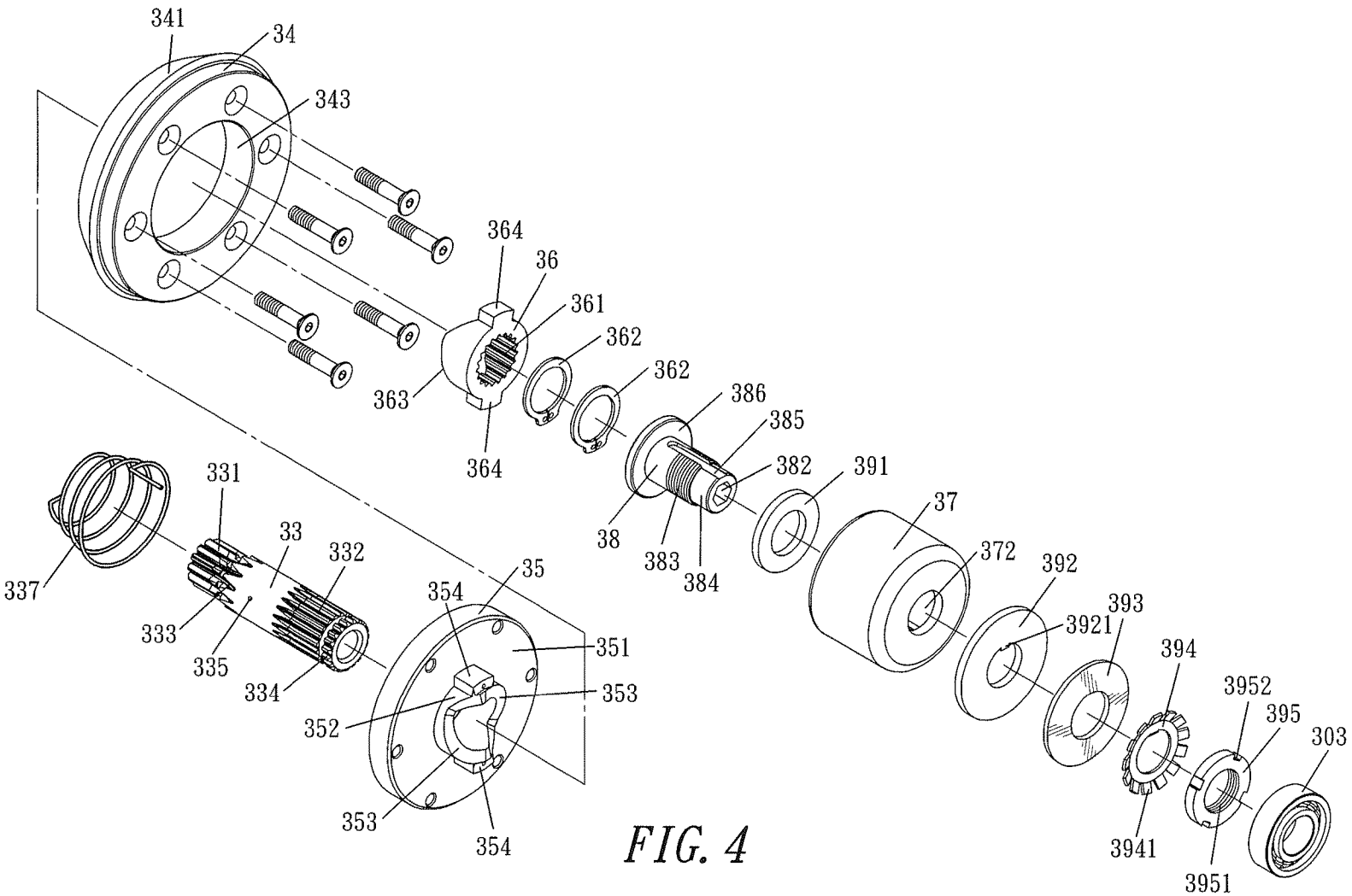
FIG. 4 is an exploded view of a torque limit mechanism in accordance with a preferred embodiment of the present invention.

A brake block 34 is made of a rubber lining material and the outer periphery of the brake block 34 is an outwardly expanded oblique friction surface 341, and a circular groove 342 is formed on the rear side of the brake block 34 (as shown in FIG. 3), and a large through hole 343 is formed at the center of the brake block 34.

Figure 2:
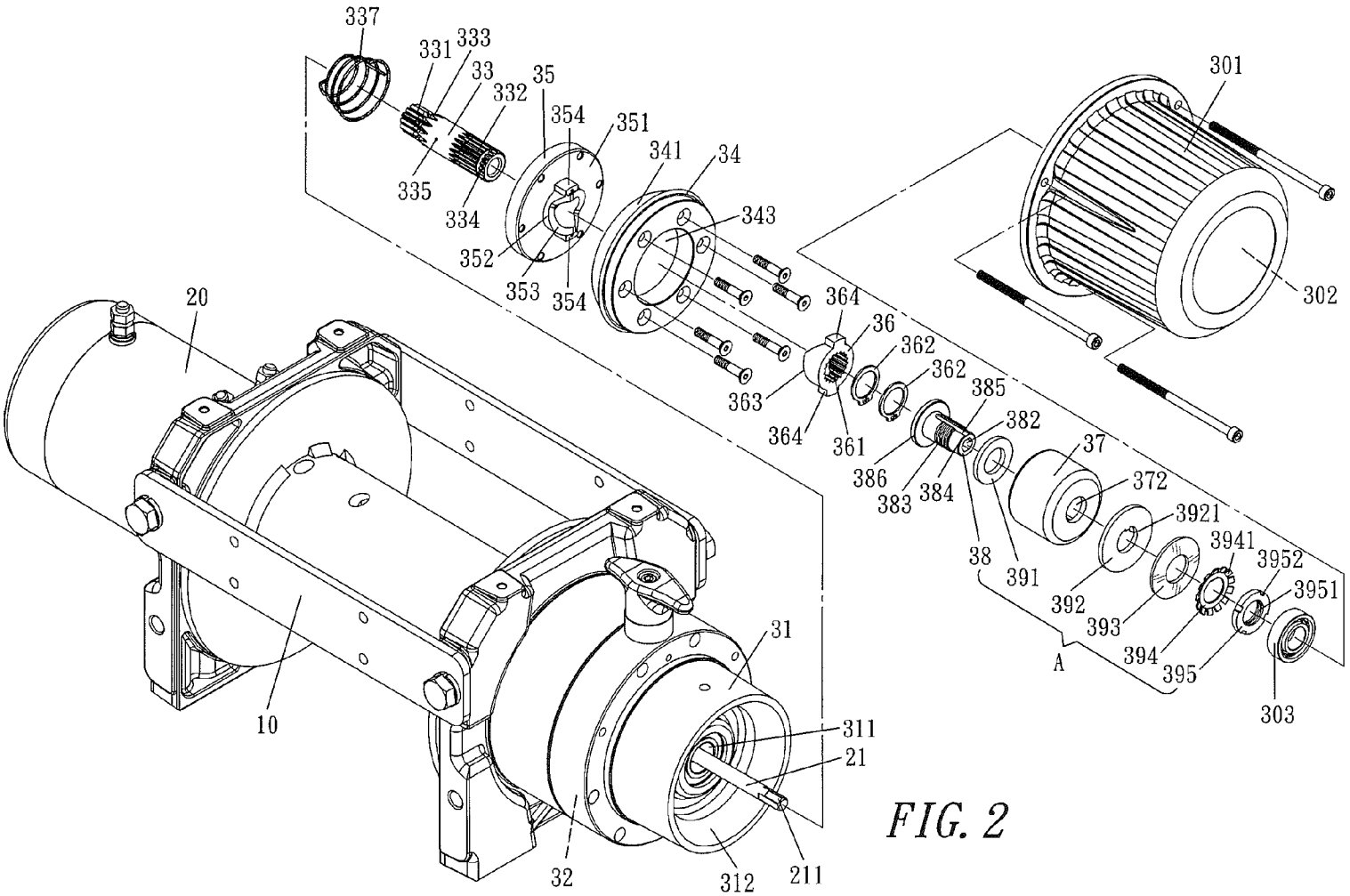
FIG. 2 is an exploded view of a preferred embodiment of the present invention.

A disc-shaped rim 35 is made of a robust material and divided into a disc-shaped portion 351 and a rim portion 352 (as shown in FIG. 2), wherein the disc-shaped portion 351 is directly attached into the circular groove 342 of the brake block 34, and a plurality of locking elements (such as bolts and screw holes) is provided for securing the brake block 34 with the disc-shaped protrusion 35 to form a jointly rotating body, and the rim portion 352 is entered into the large through hole 343 of the brake block 34, but there is a significant spacing between the outer peripheral surface of the rim portion 352 and the inner peripheral surface of the large through hole 343, and the end surface of the outer wall of the rim portion 352 has a plurality of up-and-down bevels 353, and an end position of the outer wall has a pair of outwardly protruding convex latching bodies 354, and a rear end surface of the rim portion 352 has a circular abutting slot 355 (as shown in FIG. 3), such that during assembling, the brake block 34 and the disc-shaped protrusion 35 engaged with each other to form the jointly rotating body is sheathed on the sectional shaft 33 as shown in FIG. 5, but there is no direct linkage between the two. The other end of the elastic element 34 is abutted into the circular abutting slot 355 formed on the rear end surface of the rim portion 352 for driving the jointly rotating body to move outward.

A wedge block 36 has an engaging gear 361 installed to an inner wall of a center hole of the wedge block 36 engaged and linked with the engaging gear 332 on the ring wall of the sectional shaft 33. In other words, a direct driving and rotating relation exists between the sectional shaft 33 and the wedge block 36, a set of C-shaped retainer ring 362 is latched into the engaging slot 334 of the sectional shaft 33 for limiting the wedge block 36 from displacing beyond the sectional shaft 33, and the wedge block 36 has a bevel 363 and a convex latching body 364 corresponsive to the bevel 353 and the convex latching body 354 of the disc-shaped rim 35 respectively, but both of the convex latching bodies 354, 364 are installed with slightly different angles.

An inner housing 37 facing an end of the wedge block 36 is an opening 371 (as shown in FIG. 3), and a through hole 372 is formed at an end of the inner housing away from the wedge block 36 and the interior of the through hole 372 is corresponsive to the convex latching body 354 of the disc-shaped rim 35 and the convex latching body 364 of the wedge block 36, and an internal ring wall has a corresponsive bump 373 formed thereon. Wherein, the brake block 34, the disc-shaped rim 35, the wedge block 36 and the bump 373 of the inner housing 37 jointly form a conical braking mechanism with a conical braking effect.

A torque limit mechanism A is comprised of a torsion shaft 38, a friction plate 391, a brake pad 392, a disc-shaped elastic member 393, an adjustable positioning ring 394 and a positioning screw ring 395, wherein the torsion shaft 38 has an axial through slot 381 formed therein (as shown in FIG. 3), a non-circular latching slot 382 such as a hexagonal latching slot formed at a front end of the torsion shaft 38 and corresponsive to the latching end 211 of the long shaft 21, and a small section including a threaded section 383 with a reverse outer thread is formed at the middle of the outer periphery and a positioning recession 384 is formed at a front end and having a positioning cavity 385 formed at a selected position thereon and penetrated to the inside in an axial direction, and the rear end has a ring wall 386.

The friction pad 391 is a circular plate with a friction effect, and the brake pad 392 is made of a lining material and has a positioning protrusion 3921 formed at the inner periphery of the brake pad 391. The disc-shaped elastic element 393 is in a concave arc shape and has a compressive elasticity. The outer periphery of the adjustable positioning ring 394 has a plurality of positioning plates 3941 which can be selectively bent towards the positioning screw ring 395. The positioning screw ring 395 has a shaft hole 3951 with a reverse inner thread, and a plurality of symmetrical positioning grooves 3952 formed on the outer periphery for bending, pressing, and remaining the selected positioning screw plate 3941 therein respectively.

In FIG. 5, during assembling, the torsion shaft 38 is passed through the friction plate 391 and the through hole 372 of the inner housing 37, so that the friction plate 391 is attached to the ring wall 386, and then the through slot 381 of the torsion shaft 38 is sheathed on the long shaft 21, and the latching end 211 at an end of the long shaft 21 is inserted into the latching slot 382 of the torsion shaft 38 of a close connection. During the process, the end of the opening 371 of the inner housing 37 is inserted precisely into the gap between the rim portion 352 and the large through hole 343 for a non-closely connecting insertion, while the convex latching bodies 364, 354 of the wedge block 36 and the disc-shaped rim 35 are disposed adjacent to the bump 373 of the inner housing 37, and then the brake pad 392 is sheathed on the torsion shaft 38 outside the inner housing 37, and the positioning protrusion 3921 is entered into the positioning cavity 385, and then the disc-shaped elastic member 393, the adjustable positioning ring 394 and the positioning screw ring 395 are sheathed on the torsion shaft 38 sequentially, and the shaft hole 3951 of the positioning screw ring 395 is connected to the threaded section 383 through a tight screwing engagement, until the torsion shaft 38, the friction plate 391, the inner housing 37, the brake pad 392, the disc-shaped elastic member 393, the adjustable positioning ring 394 and the positioning screw ring 395 are packed tightly, (in other words, the torque limit mechanism A and the inner housing 37 are packed), and the level of packing (or the number of screws used for connecting the shaft hole 3951 and the threaded section 383) can be adjusted according to the torque bearable by the power supply 20 (it is noteworthy that the torque bearable by the power supply 20 is indirectly proportional to the level of packing). After the level of packing is selected, the positioning plate 3941 of the adjustable positioning ring 394 is bent towards and pressed into the corresponsive (adjacent) positioning groove 3952 of the positioning screw ring 395 to limit and prevent the positioning screw ring 395 from being rotated and withdraw. The positioning plate 3941 not corresponsive (adjacent) to the positioning groove 3952 will not be bent. Finally, the rear cover 301 is covered, so that the positioning recession 384 of the torsion shaft 38 is entered and positioned into the inner periphery of the bearing 303 contained in the accommodating groove 302 of the rear cover 301.

When the power supply 20 is turned on (regardless of outputting a forward power or a reverse power), the long shaft 21 is driven to rotate by the power supply 20, and the torque limit mechanism A and the inner housing 37 are synchronously rotated by the close connection between the latching end 211 and the latching slot 382, and then the bump 373 inside the inner housing 37 pushes the convex latching bodies 354, 364 to rotate synchronously. Since the engaging gear 361 of the wedge block 36 and the engaging gear 332 on the ring wall of the sectional shaft 33 are engaged and linked with each other, the sectional shaft 33 is driven to rotate, so as to provide a predetermined deceleration effect of the reduction mechanism 32 and drive the cable wheel 40 to rotate and release a cable (not shown in the figure) or retrieve the cable.

When the power supply 20 is turned off (through a manual control/operation or a power failure), the long shaft 21, the torque limit mechanism A and the inner housing 37 will be stopped immediately, and then the cable of the cable wheel 40 carrying a load will produce a reverse torque, and the linkage of the cable and the reduction mechanism 32 pushes the sectional shaft 33 and the wedge block 36 to produce a reverse rotation, so that the convex latching body 364 of the wedge block 36 is separated with respect to the bump 373 inside the inner housing 37, and the bevel 363 of the wedge block 36 momentarily presses the bevel 353 of the disc-shaped rim 35, so that the disc-shaped rim 35 is moved quickly towards the inner circular shell 31, and the oblique friction surface 341 of the brake block 34 is attached quickly to the oblique friction surface 312 of the inner circular shell 31 to produce a braking effect for braking the brake block 34 and stopping the wedge block 36, the sectional shaft 33, the reduction mechanism 32 and the cable wheel 40 with the cable accordingly. Therefore, the conical braking mechanism jointly formed by the brake block 34, the disc-shaped rim 35, the wedge block 36 and the bump 373 of the inner housing 37 produces a conical braking effect.

The power supply 20 regardless of being turned on or off will produce a reverse torque as long as the cable is loaded. If the reverse torque produces the brake effect and/or the power supply 20 is capable of bearing the torque, then there will be no problem for the application. However, if the reverse torque produces the brake effect and/or reaches a level almost unbearable by the power supply 20, then the reverse torque will force the wedge block 36 to push the inner housing 37 to rotate in a reverse direction. Now, the torsion shaft 38 is stopped together with the power supply 20, so that the rotation of the inner housing 37 will force the friction plate 391 to rotate altogether, but the torsion shaft 38 and the brake pad 392 will be released from the compressed status with the inner housing 37 to remain still, so as to protect the power supply 20 from being damaged.

In the present invention, the power winch outputs power from the power supply 20 and transmits the power through the long shaft 21 to the reduction mechanism 32, and during this process, a torque limit mechanism A comprising a torque shaft 38, a friction pad 391, a brake pad 392, a disc-shaped elastic element 393, an adjustable positioning ring 394 and a positioning screw ring 395 and a conical braking mechanism comprising a brake block 34, a disc-shaped rim 35, a wedge block 36 and a bump 373 are installed, so that when the reverse torque produced by the carrying load of the power winch exceeds the torque bearable by the power supply, the power transmission is disconnected timely while a conical braking effect is produced, so as to assure the use of the power supply 20 and the transmission mechanism not exceeding the loading capacity and prevent the power winch from being damaged.

What is claimed is:

1. A torque limiting and conical braking assembly for a power winch, comprising: a frame, a power supply installed on a side of the frame and capable of outputting power; a reduction gearbox installed on the other side of the frame, and including a reduction mechanism installed therein, and a long shaft being driven to rotate by the power of the power supply to provide a reduction effect; and a cable wheel installed at the middle of the frame and driven to rotate by the power outputted by the reduction gearbox; and a sectional shaft being installed between the long shaft and the reduction mechanism for transmitting power indirectly, and the sectional shaft being sheathed on the long shaft, and the sectional shaft further having a first engaging gear, a second engaging gear, a first ring-shaped engaging slot, and second ring-shaped engaging slot being formed on at least one of a first and second ring wall at first and second ends of the sectional shaft, and a positioning hole being formed on the sectional shaft, and the first end of the sectional shaft being engaged and linked with the reduction mechanism by the first engaging gear at the first end, and a first C-shaped retainer ring being inserted into the first ring-shaped engaging slot at the first end of the sectional shaft, and an elastic element being sheathed on the sectional shaft, and an end of the elastic element being inserted into the positioning hole of the sectional shaft, wherein in that during the process of transmitting power from the long shaft to the reduction mechanism, a conical braking mechanism and a torque limit mechanism are installed, wherein the conical braking mechanism is formed by a brake block, a disc-shaped rim, a wedge block and a bump; the brake block has an outwardly and obliquely expanded conical friction surface formed at the outer periphery of the brake block, and a large through hole formed at the center of the brake block; the disc-shaped rim is comprised of a disc-shaped portion and a rim portion, and the disc-shaped portion and the brake block are combined into a jointly rotating body, and the rim portion is entered into the large through hole of the brake block and sheathed on the sectional shaft, and a gap exists between the rim portion and the large through hole of the brake block, and the rim portion has a plurality of up-and-down bevels formed on an end surface of the outer wall of the rim portion and a pair of outwardly protruding convex latching bodies formed at opposite ends of the outer wall of the rim portion, and the other end of the elastic element is abutted at the rear end surface of the rim portion to push the jointly rotating body to move outward; the wedge block has an engaging gear installed to an inner wall at the inner periphery of a center hole of the wedge block and engaged and linked with the second engaging gear on the second ring wall of the sectional shaft, and a second C-shaped retainer ring is inserted into the second ring-shaped engaging slot at the second end of the sectional shaft, and the wedge block has a bevel and a convex latching body corresponsive to the bevel and the convex latching body of the disc-shaped rim respectively, and the convex latching body of the wedge block and the convex latching body of the disc-shaped rim are installed with slightly different angles respectively; the bump is formed inside an inner housing which is covered onto the long shaft and a first end of the inner housing facing the wedge block is an opening and a second end away from the wedge block has a through hole, and a third ring wall at the first end of the inner housing is inserted between the large through hole of the brake block, the convex latching body of the disc-shaped rim and the convex latching body of the wedge block, and the bump is formed on the third ring wall inside the opening end of the inner housing and configured to be corresponsive to the convex latching body of the disc-shaped rim and the convex latching body of the wedge block;

the torque limit mechanism comprises a torque shaft, a friction pad, a brake pad, a disc-shaped elastic element, an adjustable positioning ring and a positioning screw ring, and the torque shaft has an axial through slot formed therein, a latching slot formed at a front end of the torque shaft, a threaded section formed at the outer periphery of the torque shaft, an axially penetrated positioning cavity, and a ring wall formed at a rear end of the torque shaft; the friction pad is a ring shaped plate having a surface with a friction effect; the brake pad is a ring shaped plate made of a lining material and has a positioning protrusion formed at the inner periphery of the brake pad; the disc-shaped elastic element is substantially in a concave arc shape and has a compressive elasticity; the outer periphery of the adjustable positioning ring has a plurality of positioning plates selectively bent towards the positioning screw ring; the positioning screw ring has a shaft hole with a reverse inner thread, and a plurality of positioning grooves symmetrically formed at the outer periphery of the positioning screw ring and for selectively bending, pressing, and remaining the positioning plates therein; during assembling, the torque shaft is passed through the friction pad and the through hole of the inner housing to attach the friction pad to the ring wall of the torque shaft, and the through slot of the torque shaft is sheathed on the long shaft, so that an end of the long shaft may be inserted into the latching slot of the torque shaft for a close connection, and then the brake pad is covered onto the torque shaft outside the inner housing, and the positioning protrusion of the brake pad is entered into the positioning cavity of the torque shaft, and the disc-shaped elastic element, the adjustable positioning ring and the positioning screw ring are sheathed on the torque shaft sequentially, and the shaft hole of the positioning screw ring is screwed and engaged with the threaded section of the torque shaft until the torque shaft, the friction pad, the inner housing, the brake pad, the disc-shaped elastic element, the adjustable positioning ring and the positioning screw ring are assembled, and then the positioning plates of the adjustable positioning ring is bent and pressed into the corresponsive positioning grooves of the positioning screw ring.

* * * * *